US011906242B2

(12) United States Patent
Zentner

(10) Patent No.: US 11,906,242 B2
(45) Date of Patent: Feb. 20, 2024

(54) SYSTEMS AND METHODS FOR ADJUSTING APPLIANCE CONTROL SETTINGS

(71) Applicant: Haier US Appliance Solutions, Inc., Wilmington, DE (US)

(72) Inventor: Martin Mitchell Zentner, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/540,329

(22) Filed: Dec. 2, 2021

(65) Prior Publication Data

US 2023/0175769 A1 Jun. 8, 2023

(51) Int. Cl.
*F25D 29/00* (2006.01)

(52) U.S. Cl.
CPC ..... *F25D 29/00* (2013.01); *F25D 2400/34* (2013.01); *F25D 2400/36* (2013.01); *F25D 2700/14* (2013.01)

(58) Field of Classification Search
CPC ..... F25D 29/00; F25D 29/005; F25D 29/006; F25D 29/008; F25D 2600/00; F24F 2130/10
See application file for complete search history.

(56) References Cited

U.S. PATENT DOCUMENTS

| | | | |
|---|---|---|---|
| 7,191,827 | B2 | 3/2007 | Junge |
| 10,830,523 | B2 | 11/2020 | Franks |
| 2019/0331409 | A1 | 10/2019 | Jung |

FOREIGN PATENT DOCUMENTS

| | | | |
|---|---|---|---|
| WO | WO2020113299 | A1 | 6/2020 |

OTHER PUBLICATIONS

JP 2020031387 A (English translation) (Year: 2020).*
WO 2021210561 A1 (English translation) (Year: 2021).*

* cited by examiner

*Primary Examiner* — Jonathan Bradford
(74) *Attorney, Agent, or Firm* — Dority & Manning, P.A.

(57) ABSTRACT

A method for adjusting temperature controls of a refrigerator appliance. The method includes scanning an indicium with a user interface, transmitting data corresponding to a registration request from the user interface to a server, and receiving, at the user interface, data corresponding to a temperature control adjustment instruction from the server.

16 Claims, 5 Drawing Sheets

SYSTEMS AND METHODS FOR ADJUSTING APPLIANCE CONTROL SETTINGS

FIELD OF THE INVENTION

The present subject matter relates generally to systems and methods for adjusting appliance control settings, such as temperature settings for refrigerator appliances.

BACKGROUND OF THE INVENTION

Refrigerator appliances are not always installed within a climate-controlled area of a building, such as a kitchen. Refrigerator appliances installed within a garage or other locations where local temperature control is negligible may require adjustment of the refrigeration appliance to account for seasonal temperature variations. Certain refrigerator appliances require a user to manually change the refrigerator temperature controls when the ambient temperature crosses a threshold.

When the controls are not adjusted to account for seasonal temperature variations, the refrigerator appliance may not function properly. For instance, in a top-mount refrigerator appliance, the upper freezer chamber may become too warm and not function as intended when the refrigerator temperature controls are not adjusted to account for winter conditions. However, users often forget to manually change the controls, or the users change the controls incorrectly.

BRIEF DESCRIPTION OF THE INVENTION

Aspects and advantages of the invention will be set forth in part in the following description, or may be apparent from the description, or may be learned through practice of the invention.

In one example embodiment, a method for adjusting temperature controls of a refrigerator appliance includes scanning an indicium with a user interface. The indicium positioned on the refrigerator appliance. The method also includes transmitting data corresponding to a registration request from the user interface to a server. The registration request includes a location of the refrigerator appliance. The method further includes receiving, at the user interface, data corresponding to a temperature control adjustment instruction from the server when an ambient temperature at the location of the refrigerator appliance includes one of the ambient temperature less than a lower threshold temperature and the ambient temperature greater than an upper threshold temperature.

In another example embodiment, a method for adjusting temperature controls of a refrigerator appliance includes receiving, at a server, data corresponding to a registration request from a user interface located proximate the refrigerator appliance. The registration request includes a location of the refrigerator appliance. The method also includes determining an ambient temperature at the location of the refrigerator appliance and transmitting, from the server, data corresponding to a temperature control adjustment instruction to the user interface when an ambient temperature at the location of the refrigerator appliance includes one of the ambient temperature less than a lower threshold temperature and the ambient temperature greater than an upper threshold temperature.

In another example embodiment, a method for adjusting temperature controls of an appliance includes scanning an indicium located on an appliance with a user interface. The user interface is separate from the appliance. The method also includes transmitting data from the user interface to a server. The data includes the location of the appliance. The method further includes receiving, at the user interface from the server, data corresponding to instructions for a control adjustment based upon the location of the appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
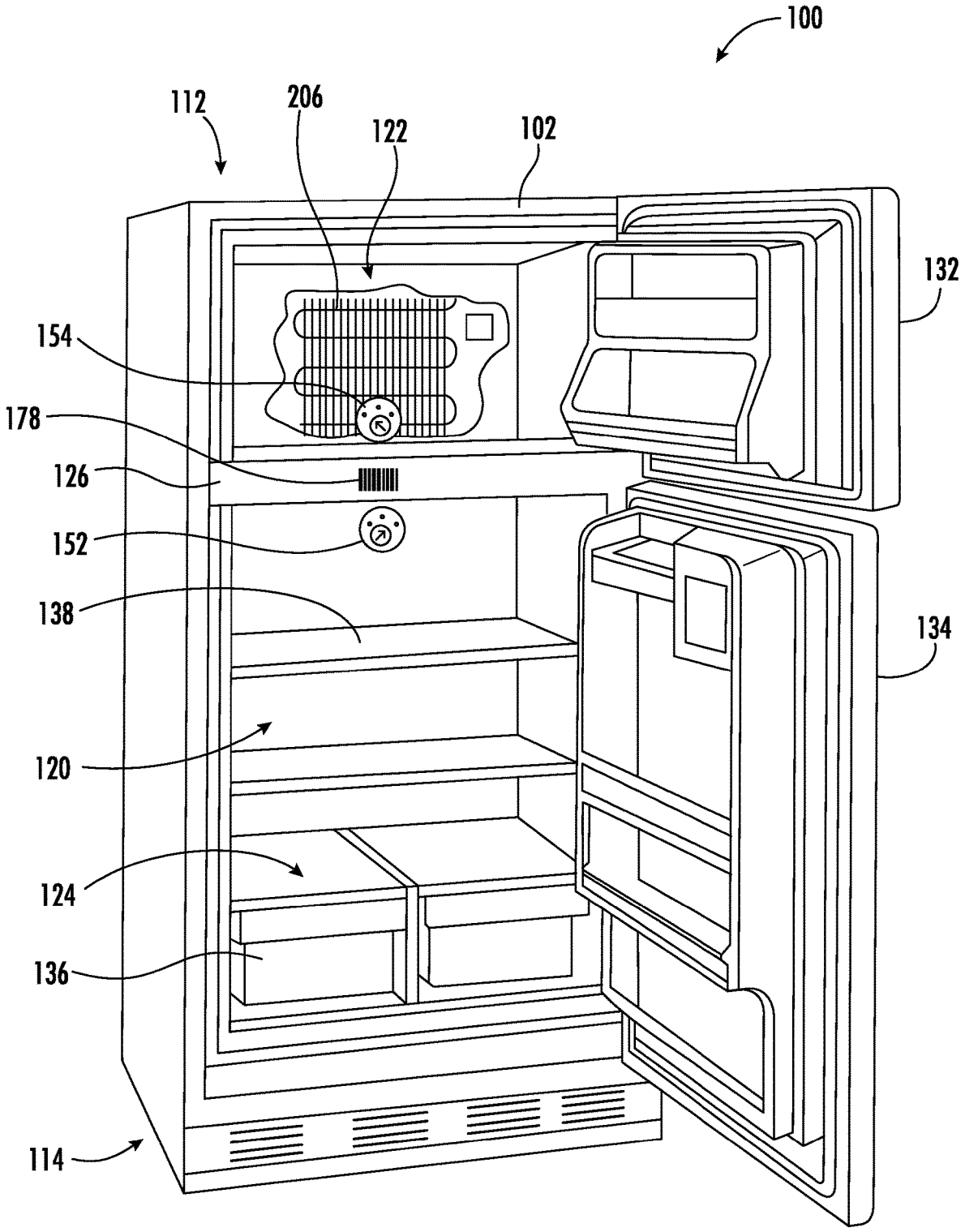
FIG. 1 is a perspective view of an appliance according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Referring now to the figures, an example appliance will be described in accordance with example aspects of the present subject matter. Specifically, FIG. 1 provides a perspective view of an example refrigerator appliance 100 with the doors in the open position.

According to example embodiments, refrigerator appliance 100 includes a cabinet 102 that is generally configured for containing and/or supporting various components of refrigerator appliance 100 and which may also define one or more internal chambers or compartments of refrigerator appliance 100. In this regard, as used herein, the terms "cabinet," "housing," and the like are generally intended to refer to an outer frame or support structure for refrigerator appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of refrigerator appliance 100. By contrast, cabinet 102 may enclose some or all portions of an interior of cabinet 102. It should be appreciated that cabinet 102 may have any suitable size, shape, and configuration while remaining within the scope of the present subject matter.

Cabinet 102 defines chilled chambers for receipt of food items for storage. In particular, cabinet 102 defines fresh food chamber 124 positioned at or adjacent a bottom portion 114 of cabinet 102 and a freezer chamber 122 arranged at or adjacent a top portion 112 of cabinet 102. As such, refrigerator appliance 100 is generally referred to as a top mount refrigerator appliance. It is recognized, however, that the benefits of the present disclosure apply to other types and styles of refrigerator appliances such as, e.g., a bottom mount refrigerator appliance, a side-by-side style refrigerator appliance, or a single door refrigerator or freezer appliance. Moreover, aspects of the present subject matter may be applied to other appliances as well. Consequently, the description set forth herein is for illustrative purposes only and is not intended to be limiting in any aspect to any particular appliance or configuration.

In general, refrigerator door 134 forms a seal over a front opening 120 defined by cabinet 102. In this regard, a user may place items within fresh food chamber 124 through front opening 120 when refrigerator door 134 is open and may then close refrigerator door 134 to facilitate climate control. Refrigerator doors 134 and freezer door 132 are shown in the open configuration in FIG. 1. One skilled in the art will appreciate that other chamber and door configurations are possible and within the scope of the present invention.

As shown in FIG. 1, various storage components are mounted within fresh food chamber 124 to facilitate storage of food items therein as will be understood by those skilled in the art. In particular, the storage components may include bins 136 and shelves 138. Each of these storage components are configured for receipt of food items (e.g., beverages and/or solid food items) and may assist with organizing such food items. It should be appreciated that the illustrated storage components are used only for the purpose of explanation and that other storage components may be used and may have different sizes, shapes, and configurations.

A control knob 152 is disposed inside the fresh food chamber 124 and is configured for controlling the mode of operation in the fresh food chamber 124. Control knob 152 may be in signal communication with a processing device or controller 218 (FIG. 2) and adjusting control knob 152 may signal controller 218. In turn, signals generated in controller 218 may operate refrigerator appliance 100 in response to the setting of the control knob 152. For example, a user may adjust control knob 152, and controller 218 may adjust operation of refrigerator appliance 100 in response to the adjustment of control knob 152. Moreover, controller 218 may adjust the temperature setting of fresh food chamber 124 in response to the adjustment of control knob 152. A control knob 154 may also be disposed inside the freezer chamber 122, and control knob 154 may be configured for controlling a damper 222 (FIG. 2) in a mullion 126. Thus, control knob 154 may be coupled to damper 222, and changing the settings of control knob 154 may adjust damper 222, e.g., to increase or decrease airflow between the freezer chamber 122 and fresh food chamber 124. As may be seen from the above, control knob 152 and control knob 154 may each be manually adjustable to adjust the set temperatures of freezer chamber 122 and fresh food chamber 124, and controller 218 does not automatically adjust the set temperatures of freezer chamber 122 and fresh food chamber 124. Controller 218 may operate in response to the manual adjustment of control knob 152 and control knob 154. In other example embodiments, a single control knob may be used to control the temperature in both chambers of refrigerator appliance 100.

Operation of refrigerator appliance 100 can be regulated by controller 218 that is operatively coupled to control knob 152 and various other components, as will be described below. Generally, in response to user manipulation of control knob 152 or one or more sensor signals, controller 218 may operate various components of refrigerator appliance 100. Controller 218 may include a memory and one or more microprocessors, CPUs or the like, such as general or special purpose microprocessors operable to execute programming instructions or micro-control code associated with operation of refrigerator appliance 100. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 218 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 218 may be positioned in a variety of locations throughout refrigerator appliance 100. Input/output ("I/O") signals may be routed between controller 218 and various operational components of refrigerator appliance 100. For example, control knob 152 and a compressor 202 (FIG. 2) may be in communication with controller 218 via one or more signal lines or shared communication busses. Additionally or alternatively, controller 218 may be in communication with various other components of refrigerator appliance 100. For example, various valves, switches, lights, sensors, etc. may be actuatable based on commands from the controller 218.

Figure 2:
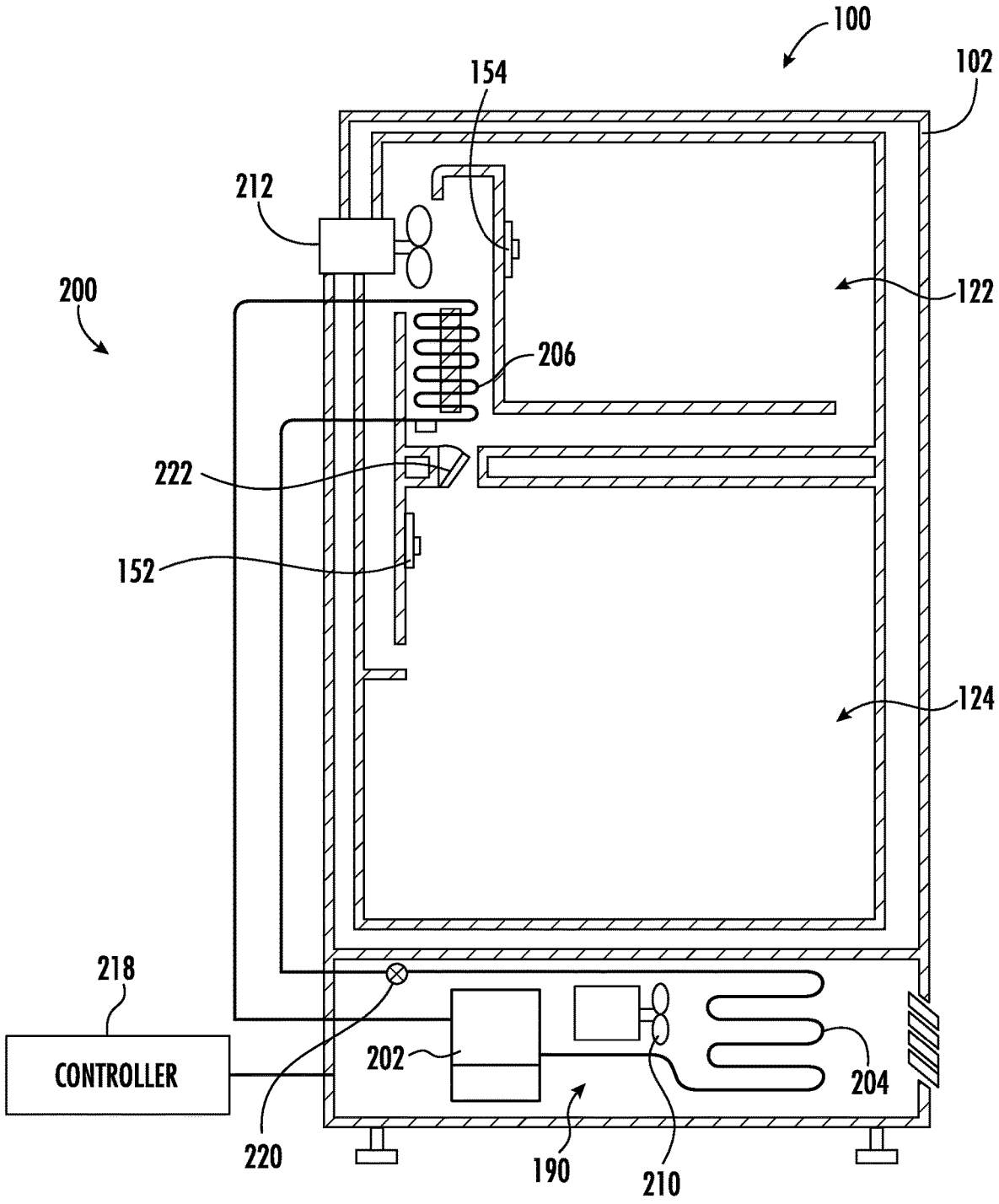
FIG. 2 is a schematic view of certain components of the example appliance of FIG. 1.

FIG. 2 is a schematic view of certain components of refrigerator appliance 100, including a sealed refrigeration system 200. A machinery compartment 190 of cabinet 102 contains components for executing a known vapor compression cycle for cooling air. The components include a compressor 202, a condenser 204, an expansion device 220, and an evaporator 206 connected in series and charged with a refrigerant. As will be understood by those skilled in the art, refrigeration system 200 may include additional components, e.g., at least one additional evaporator, compressor, expansion device, and/or condenser.

Within refrigeration system 200, refrigerant flows into compressor 202, which operates to increase the pressure of the refrigerant. This compression of the refrigerant raises its temperature, which is lowered by passing the refrigerant through condenser 204. Within condenser 204, heat exchange with ambient air takes place so as to cool the refrigerant. A fan 210 may be used to pull air across condenser 204 so as to provide forced convection for a more rapid and efficient heat exchange between the refrigerant within condenser 204 and the ambient air. Thus, as will be understood by those skilled in the art, increasing air flow across condenser 204 can, e.g., increase the efficiency of condenser 204 by improving cooling of the refrigerant contained therein. In alternative example embodiments, condenser 204 may operate with natural convection as opposed to forced convection.

An expansion device (e.g., a valve, capillary tube, or other restriction device) 220 receives refrigerant from condenser 204. From expansion device 220, the refrigerant enters evaporator 206. Upon exiting expansion device 220 and entering evaporator 206, the refrigerant drops in pressure. Due to the pressure drop and/or phase change of the refrigerant, evaporator 206 is cool relative to the fresh food chamber 124 and freezer chamber 122. As such, cooled air is produced and refrigerates the fresh food chamber 124 and the freezer chamber 122. Thus, evaporator 206 is a type of heat exchanger which transfers heat from air passing over evaporator 206 to refrigerant flowing through evaporator 206. A fan 212 is used to pull air across evaporator 206 so as to provide forced convection for a more rapid and efficient heat exchange between the refrigerant within evaporator 206 and air within the fresh food chamber 124 and the freezer chamber 122. Thus, as will be understood by those skilled in the art, increasing air flow across evaporator 206 can, e.g., increase the efficiency of evaporator 206 by improving heat transfer to the refrigerant contained therein. In alternative example embodiments, sealed refrigeration system 200 does not include fan 212, and the heat transfer may occur using a cold wall methodology, such as used in chest freezers. Fan 212 may also draw air from fresh food chamber 124 through a rear duct across evaporator 206. As noted above, damper 222 may regulate air flow between fresh food chamber 124 and freezer chamber 122 in order to control the temperature of fresh food chamber 124.

Collectively, the vapor compression cycle components in a refrigeration circuit, associated fans, and associated compartments are sometimes referred to as a sealed refrigeration system operable to force cold air through the fresh food chamber 124 and freezer chamber 122. The refrigeration system 200 depicted in FIG. 2 is provided by way of example only. Thus, it is within the scope of the present subject matter for other configurations of the refrigeration system to be used as well.

Figure 5:
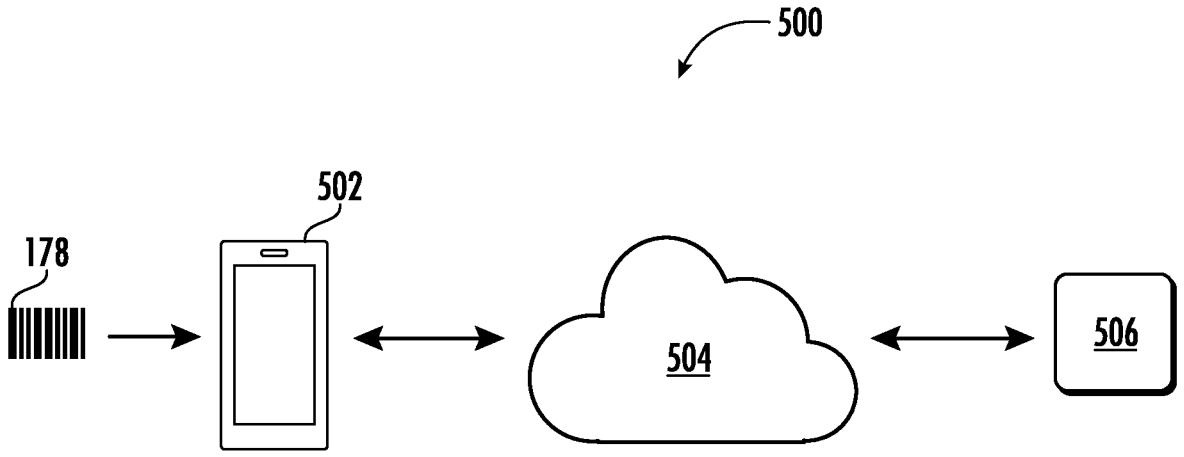
FIG. 5 is a perspective view of the external communications system according to an example embodiment of the present disclosure.

Referring generally to FIG. 5, external communication system 500 will be described according to an example embodiment of the present subject matter. In general, external communication system 500 is configured for permitting interaction, data transfer, and other communications between a server 506 and one or more external user interface 502. For example, this communication may be used to receive user instructions or notifications, or any other suitable information for improving performance of refrigerator appliance 100. In addition, it should be appreciated that external communication system 500 may be used to transfer data or other information to improve performance of one or more external devices or appliances and/or improve user interaction with such devices.

For example, external communication system 500 permits an external user interface 502 to communicate with a server 506. As described in more detail below, these communications may be facilitated using a wired or wireless connection, such as via a network 504. In general, external user interface 502 may be any suitable device separate from refrigerator appliance 100 that is configured to provide and/or receive communications, information, data, or commands from a user. In this regard, external user interface 502 may be, for example, a personal phone, a smartphone, a tablet, a laptop or personal computer, a wearable device, a smart home system, or another mobile or remote device.

External user interface 502 may also include a camera, a scanner, a reader, etc. for detecting an indicium 178. For example, indicium 178 may be located on mullion 126. In general, one of ordinary skill in the art would appreciate that indicium 178 could be located elsewhere within cabinet 102 or, generally, on the refrigerator appliance 100. Indicium 178 may be a barcode, Quick Response (QR) code, radio frequency identification (RFID) tag, etc. that triggers, instruct, or requests external user interface 502 to communicate with server 506 via network 504.

As may be seen from the above, server 506 may be in communication with external user interface 502 through network 504. In this regard, for example, server 506 may be a remote cloud-based server, and is thus located at a distant location, such as in a separate city, state, country, etc. According to an example embodiment, external user interface 502 may communicate with a remote server 506 over network 504, such as the Internet, to transmit/receive data or information, receive user notifications or instructions about refrigerator appliance 100, etc.

In general, communication between external user interface 502 and server 506, may be carried using any type of wired or wireless connection and using any suitable type of communication network, non-limiting examples of which are provided below. For example, network 504 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

Refrigerator appliance 100 may include features that require work to operate during Sabbath or Shabbat. Thus, appliances may include a Sabbath mode that prevents the appliance from performing certain functions while also permitting operation of the appliances during Sabbath. Generally, a user may manually activate the Sabbath mode with a user input of the appliance. External communication system 500 may be utilized to instruct a user on when and how to adjust refrigerator appliance 100 when entering or exiting Sabbath.

External communication system 500 is described herein according to an example embodiment of the present subject matter. However, it should be appreciated that the example functions and configurations of external communication system 500 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 3:
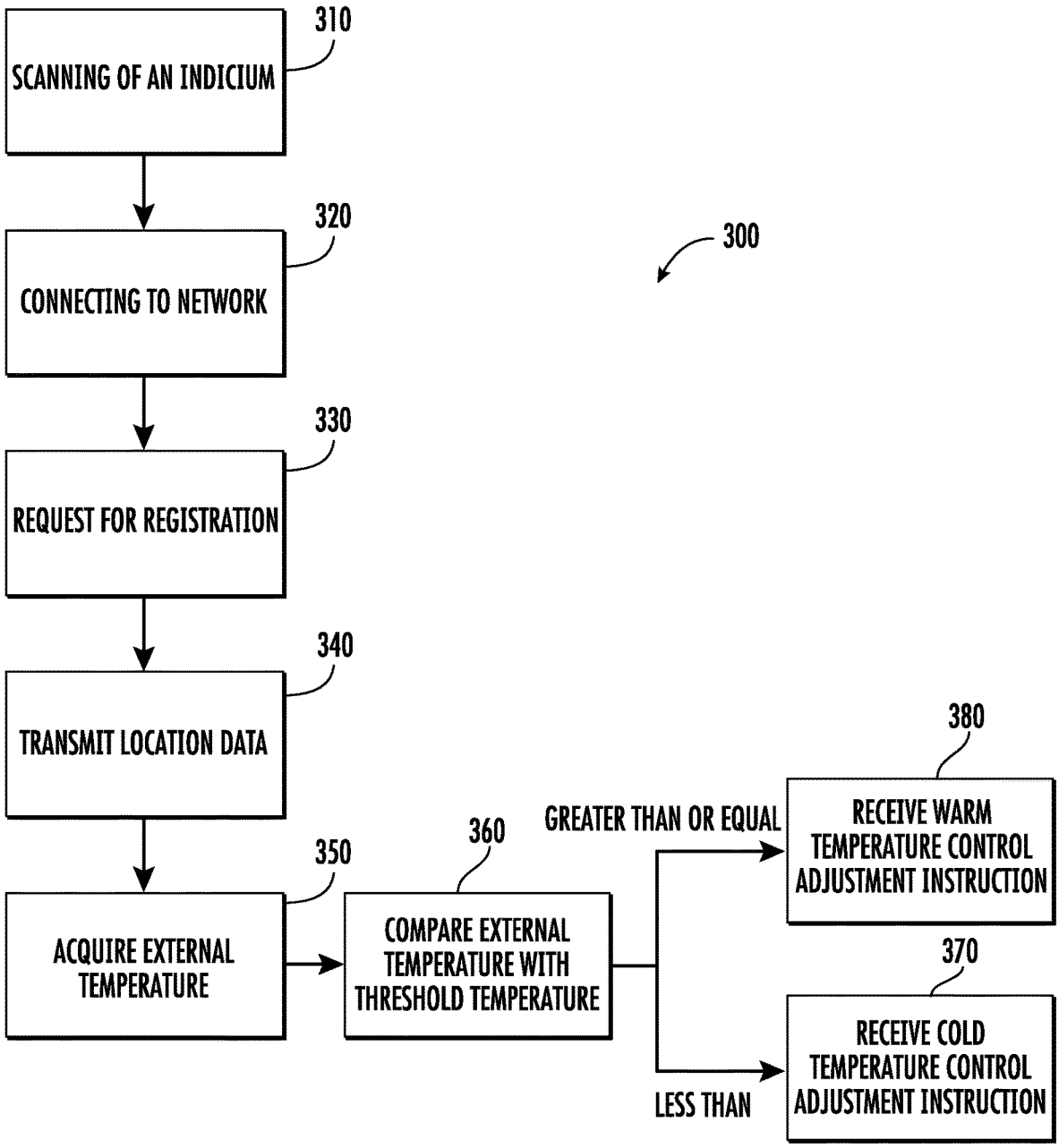
FIG. 3 is a flow chart illustrating a method for adjusting temperature controls of a refrigerator appliance according to an example embodiment of the present disclosure.

Referring generally to FIG. 3, also with reference to FIG. 5, a method 300 of adjusting appliance control settings, such as fresh food control knob 152 and freezer control knob 154 in refrigerator appliance 100, is provided. As discussed in greater detail below, method 300 may assist in improving operation of refrigerator appliance 100. Method 300 may assist with instructing a user of refrigerator appliance 100 and external user interface 502 to adjust the temperature controls of refrigerator appliance 100 with respect to the external temperature. While described in greater detail below in the context of refrigerator appliance 100, it will be understood that method 300 may be used in or with any other suitable appliance to instruct a user of the appliance to adjust controls of the appliance.

According to example embodiments, at 310, method 300 may include the user scanning indicium 178, located on the refrigerator appliance 100, with external user interface 502. The indicium 178 may be a barcode or a QR code. The indicium 178 may be positioned on the cabinet 102, in the cabinet 102, or on the mullion 126 of refrigerator appliance 100. The indicium 178 may be positioned where indicium 178 is scannable using an external user interface 502. For example, in one example embodiment, a cellphone as external user interface 502 may be used to scan a barcode as indicium 178 on cabinet 102 of refrigerator appliance 100. In another embodiment, a tablet as external user interface 502 may be used to scan a QR code as indicium 178 on the inside of the cabinet 102 of refrigerator appliance 100.

At 320, the external user interface 502 may be connected to and/or communicate over network 504. Network 504 may also be connected with server 506. In general, communication between external user interface 502 and server 506, may be carried using any type of wired or wireless connection and using any suitable type of communication network at 320.

At 330, server 506 may send a request for registration to the external user interface 502, e.g., in response to the external user interface 502 scanning indicium 178 at 310. At 330, the user may register refrigerator appliance 100 with server 506. Server 506 may send a request for registration in the form of a webpage, or a downloadable application to external user interface 502 at 330. The user may use external user interface 502 to complete the actions in the request. For example, the user may input a serial number or other identifying code of refrigerator appliance 100 into the webpage or application to register refrigerator appliance 100 with server 506 at 330.

At 340, e.g., while the user is completing the request for registration at 330, the external user interface 502 may transmit the location of the external user interface 502 to server 506. The location of external user interface 502 may be determined, e.g., using multilateration of radio signals, the Global Positioning System (GPS), the Global System for Mobile Communications (GSM), etc. Because external user interface 502 is used to scan indicium 178 at 310, external user interface 502 may be located proximate refrigerator appliance 100 at 340. Thus, the location data from external user interface 502 at 340 may also correspond to the location of refrigerator appliance 100. The location data may assist server 506 with determining the seasonal weather at the location of the refrigerator appliance 100. For example, in January, a user may scan a barcode on refrigerator appliance 100 with a cellphone in a district of London, England, and a remote server 506 in Arizona of the United States can acquire the location of the cellphone to subsequently determine the relative seasonal weather at the refrigerator appliance 100.

At 350, the location data of the external user interface 502 from 340 may be used to determine the external temperature at refrigerator appliance 100. For example, server 506 may use the location of the external user interface 502 in order to determine the external temperature at refrigerator appliance 100. As an example, server 506 may obtain the external temperature at refrigerator appliance 100 from a weather service via network 504. Thus, e.g., server 506 can further use the location data from the cellphone at 340 to determine the temperature at the refrigerator appliance 100. Moreover, using the previously determined location of the cellphone as a district of London, England, server 506 can further determine that the temperature is seven degrees Celsius in that specific district of London at refrigerator appliance 100.

It will be understood that determining the external temperature at refrigerator appliance 100 at 350 may be performed at a period of time (e.g., days, weeks, or months) after completing the request for registration at 330 and/or determining the external temperature at refrigerator appliance 100 at 340. In addition, it will be understood that the external temperature at refrigerator appliance 100 may be determined at 350 periodically or intermittently to assist with identifying seasonal weather changes at refrigerator appliance 100.

As may be seen from the above, server 506 may obtain the external temperature at refrigerator appliance 100 from a weather service. For example, a weather service may be the National Weather Service (NWS) or other similar services, from which the location may be utilized to find the external temperature at refrigerator appliance 100. The external temperature at refrigerator appliance 100 may be average weather data determined from the weather service using the location corresponding to a state, city, postal code, area code, etc.

At 360, the external temperature acquired at 350 is compared to a threshold temperature. For example, server 506 may compare the external temperature acquired at 350 to a threshold temperature stored in server 506. Server 506 may then determine if the external temperature is less than the threshold temperature or the external temperature is greater than the threshold temperature. For example, it may be determined the temperature in a district of London England is seven degrees Celsius, which is less than the threshold temperature of thirteen degrees Celsius.

At 370, it may have been determined that the external temperature is less than the threshold temperature, and a corresponding temperature control adjustment instruction may be received by and/or presented on the external user interface 502. The temperature control adjustment instruction may be in the form of a portable document format (PDF), image, instant message, push notification, or any message readable by the external user interface 502. For example, refrigerator appliance 100 at a location where the temperature is less than thirteen degrees Celsius may result in external user interface 502 receiving an image with temperature control adjustment instructions that are specific to the adjusting of refrigerator appliance 100 controls with the outside temperature being less than the threshold. This enables the user to correctly adjust the temperature controls of refrigerator appliance 100.

At 380, for example, it may have been determined that the external temperature is greater than the threshold temperature, and a corresponding warm temperature control adjustment instruction may be received by and/or presented on the external user interface 502. For example, refrigerator appliance 100 at a location where the temperature is greater than or equal to thirteen degrees Celsius may result in external user interface 502 receiving an image with temperature control adjustment instructions that are specific to the adjusting of the refrigerator appliance 100 controls with the outside temperature being greater than the threshold. This enables the user to correctly adjust the temperature controls of refrigerator appliance 100.

Figure 4:
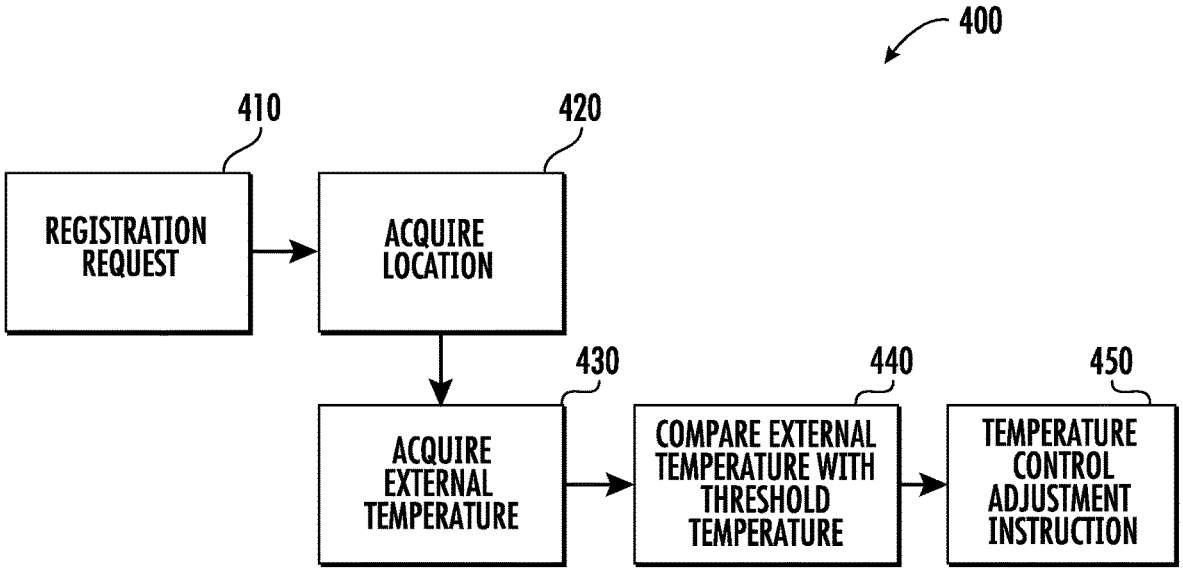
FIG. 4 is another flow chart illustrating a method for adjusting temperature controls of a refrigerator appliance according to an example embodiment of the present disclosure.

Referring generally to FIG. 4, also with reference to FIG. 5, a method 400 of adjusting appliance control settings, such as fresh food control knob 152 and freezer control knob 154 in refrigerator appliance 100, is provided. As discussed in greater detail below, method 400 may assist in improving operation of refrigerator appliance 100. Method 400 may assist with instructing a user of refrigerator appliance 100 to adjust the temperature controls of a refrigerator appliance 100 with respect to the local external temperature. While described in greater detail below in the context of refrigerator appliance 100, it will be understood that method 400 may be used in or with any other suitable appliance to instruct a user of the appliance to adjust controls of the appliance.

According to example embodiments, at 410, method 400 may include a registration request being received by server 506 through network 504. The refrigerator appliance 100 may be registered with server 506. For example, server 506 may receive a registration request from external user interface 502, e.g., a cellphone, through network 504. In the registration request, external user interface 502 may supply server 506 with a serial number or other identifying code to register the refrigerator appliance with server 506. The external user interface 502 may have obtained the serial number or other identifying code by scanning indicium 178, e.g., in the manner described above for method 300.

At 420, e.g., as part of the registration request at 410, location data pertaining to an external location may be obtained by server 506. For example, server 506 can acquire the location of external user interface 502, e.g., such as a cellphone, used to send the registration request. The location of external user interface 502 may be determined, e.g., using multilateration of radio signals, GPS, GSM, etc. The location data from external user interface 502 at 420 may also correspond to the location of refrigerator appliance 100. The location data may thus assist server 506 with determining the seasonal weather at the location of the refrigerator appliance 100.

At 430, server 506 may acquire an external temperature. As an example, server 506 may obtain the external temperature at refrigerator appliance 100 from a weather service via network 504. Thus, e.g., server 506 can further use the location data from the cellphone at 340 to determine the temperature at the refrigerator appliance 100. For example, since server 506 correlates the known location of external user interface 502 from 420 with the location of refrigerator appliance 100, a temperature reading at or around that location may be determined by server 506 at 430 in order to acquire external temperature around refrigerator appliance 100.

At 440, the external temperature at 430 may be compared to a threshold temperature. For example, server 506 may compare the external temperature acquired at 430 to a threshold temperature stored in server 506. Server 506 may then determine whether the temperature is higher or lower than the threshold value which is stored in server 506. For example, server 506, having already determined the external temperature around refrigerator appliance 100 is sixteen degrees Celsius, compares that temperature to the threshold temperature of thirteen degrees Celsius, and determines that the external temperature around refrigerator appliance 100 is greater than the threshold temperature.

At 450, server 506 may send a temperature control adjustment instruction across network 504 based upon the comparison of the temperatures at 440. The temperature control adjustment instruction may be in the form of a PDF, image, instant message, push notification, or any message readable by the external user interface 502. For example, server 506 may send a PDF of a corresponding temperature control adjustment instructions to external user interface 502, such as a cellphone. This enables the user to correctly adjust the temperature controls of refrigerator appliance 100.

FIGS. 3 and 4 depict steps performed in a particular order for purposes of illustration and discussion. Those of ordinary skill in the art, using the disclosures provided herein, will understand that the steps of any of the methods discussed herein may be adapted, rearranged, expanded, omitted, or modified in various ways without deviating from the scope of the present disclosure. Moreover, although aspects of methods 300, 400 are explained using refrigerator appliance 100 as an example, it should be appreciated that these methods may be applied to the operation of any suitable appliance.

As may be seen from the above, the present disclosure may allow a manufacturer to contact a user of a refrigerator appliance 100 to notify them instructions of when and how to change the control settings of refrigerator 100 so that refrigerator appliance 100 works properly throughout the changing seasons of the year. For the refrigerator appliance 100 to work properly in a location where there is negligible control on the ambient temperature, such as within a garage, the user may change the control settings on the refrigerator appliance 100 to match the received instructions, which have been sent as a timely reminder to the user, e.g., on a smartphone or tablet computer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for adjusting temperature controls of a refrigerator appliance, comprising:

scanning an indicium with a user interface separate from the refrigerator appliance, the indicium positioned on the refrigerator appliance;

transmitting data corresponding to a registration request from the user interface to a server, the data corresponding to the registration request comprising a location of the refrigerator appliance; and receiving, at the user interface, data corresponding to a temperature control adjustment instruction from the server in response to an ambient temperature at the location of the refrigerator appliance comprising one of the ambient temperature less than a lower threshold temperature and the ambient temperature greater than an upper threshold temperature, wherein a temperature setting of the refrigerator appliance is only manually adjustable.

2. The method of claim 1, wherein the indicium comprises one of a barcode and a QR-code.

3. The method of claim 1, wherein the user interface comprises one of a cellphone and a tablet.

4. The method of claim 1, wherein the location comprises GPS data transmitted by the user interface.

5. The method of claim 1, wherein the lower threshold temperature is no greater than thirteen degrees Celsius.

6. The method of claim 1, wherein the upper threshold temperature is no less than thirteen degrees Celsius.

7. The method of claim 1, wherein the ambient temperature at the location of the refrigerator appliance is determined based on a weather service at the location of the refrigerator appliance.

8. The method of claim 7, wherein the weather service comprises average weather data corresponding to a postal code, the average weather data is indicative of the temperature control adjustment instruction received by the user interface.

9. A method for adjusting temperature controls of a refrigerator appliance, comprising:

receiving, at a server, data corresponding to a registration request from a user interface located proximate the refrigerator appliance, the data corresponding to the registration request comprising a location of the refrigerator appliance;

determining an ambient temperature at the location of the refrigerator appliance; and transmitting, from the server, data corresponding to a temperature control adjustment instruction to the user interface in response to the ambient temperature at the location of the refrigerator appliance comprising one of the ambient temperature less than a lower threshold temperature and the ambient temperature greater than an upper threshold temperature, wherein a temperature setting of the refrigerator appliance is only manually adjustable.

10. The method of claim 9, wherein the user interface comprises one of a cellphone and a tablet.

11. The method of claim 9, wherein the location comprises GPS data transmitted by the user interface.

12. The method of claim 9, wherein the lower threshold temperature is no greater than thirteen degrees Celsius.

13. The method of claim 9, wherein the upper threshold temperature is no less than thirteen degrees Celsius.

14. The method of claim 9, wherein the ambient temperature at the location of the refrigerator appliance is determined based on a weather service at the location of the refrigerator appliance.

15. The method of claim 14, wherein the weather service comprises average weather data corresponding to a postal code, the average weather data is indicative of the temperature control adjustment instruction received by the user interface.

16. A method for adjusting temperature controls of an appliance, comprising:

scanning an indicium located on an appliance with a user interface separate from the refrigerator appliance, the user interface being separate from the appliance;

transmitting a data from the user interface to a server, the data comprising a location of the appliance; and receiving, at the user interface from the server, data corresponding to instructions for a control adjustment based upon the location of the appliance, wherein a temperature setting of the appliance is only manually adjustable.

* * * * *